US009222281B2

(12) United States Patent
Fowler et al.

(10) Patent No.: US 9,222,281 B2
(45) Date of Patent: Dec. 29, 2015

(54) SELF-ADJUSTING CYLINDER MONITOR ASSEMBLY

(75) Inventors: Tracy R. Fowler, West Haven, CT (US); Brian R. Fournier, Canton, CT (US); Damon J. Lenk, Bristol, CT (US); Scott Morstatt, Lenoir City, TN (US)

(73) Assignee: Corbin Russwin Architectural Hardware, Berlin, CT (US)

( * ) Notice: Subject to any disclaimer, the term of this patent is extended or adjusted under 35 U.S.C. 154(b) by 435 days.

(21) Appl. No.: 12/697,800

(22) Filed: Feb. 1, 2010

(65) Prior Publication Data

US 2010/0192650 A1 Aug. 5, 2010

Related U.S. Application Data

(60) Provisional application No. 61/148,519, filed on Jan. 30, 2009.

(51) Int. Cl.

| | |
|---|---|
| ***E05B 39/00*** | (2006.01) |
| ***E05B 17/22*** | (2006.01) |
| ***E05B 63/00*** | (2006.01) |
| ***E05B 63/08*** | (2006.01) |
| *E05B 47/00* | (2006.01) |
| *H01H 27/06* | (2006.01) |
| *H01H 36/00* | (2006.01) |

(52) U.S. Cl.

CPC ..... *E05B 17/22* (2013.01); *E05B 63/006* (2013.01); *E05B 63/08* (2013.01); *E05B 2047/0069* (2013.01); *H01H 27/06* (2013.01); *H01H 36/0046* (2013.01); *Y10T 70/7559* (2015.04); *Y10T 70/80* (2015.04)

(58) Field of Classification Search

USPC ..... 70/432, 434, 441, DIG. 49, DIG. 59, 70/275, 278.2, 278.3, 283.1

See application file for complete search history.

(56) References Cited

U.S. PATENT DOCUMENTS

| | | | | |
|---|---|---|---|---|
| 3,710,317 A | | 1/1973 | Colsen et al. | |
| 3,787,812 A | * | 1/1974 | Armstrong | 70/283 |
| 4,009,357 A | | 2/1977 | Naylor | |
| 4,078,405 A | * | 3/1978 | Steinbach | 70/491 |
| 4,114,412 A | * | 9/1978 | Braatz | 70/441 |

(Continued)

FOREIGN PATENT DOCUMENTS

| | | |
|---|---|---|
| DE | 4422096 A1 | 1/1996 |
| EP | 0722156 A1 | 7/1996 |
| GB | 2175446 A | 11/1986 |

OTHER PUBLICATIONS

Corbin Russwin Architectural Hardware, International Preliminary Report on Patentability issued for International Application No. PCT/US2010/022751, dated Feb. 14, 2011, 14 pages.

(Continued)

*Primary Examiner* — Christopher Boswell

(74) *Attorney, Agent, or Firm* — Michael G. Johnston; Moore & Van Allen PLLC

(57) ABSTRACT

A lock cylinder monitoring assembly for monitoring position of a lock cylinder. The monitoring assembly includes a housing having an inner cavity and an exterior diameter. The exterior diameter of the housing is not significantly greater than the corresponding cylinder diameter. The assembly further includes a switch received into the inner cavity of the housing. The switch is in electrical communication with an indicator. The switch is reactive to any change in position of the lock cylinder.

14 Claims, 10 Drawing Sheets

(56) References Cited

U.S. PATENT DOCUMENTS

| | | | | | |
|---|---|---|---|---|---|
| 4,148,202 | A | * | 4/1979 | Wegrzyn | 70/431 |
| 4,328,691 | A | * | 5/1982 | Scherbing | 70/491 |
| 4,760,380 | A | * | 7/1988 | Quenneville et al. | 70/441 |
| 4,829,798 | A | | 5/1989 | Roop | |
| 5,996,383 | A | * | 12/1999 | Adelmeyer et al. | 70/454 |
| 6,038,895 | A | * | 3/2000 | Menke et al. | 70/278.1 |
| 6,125,673 | A | * | 10/2000 | Luker | 70/276 |
| 6,363,763 | B1 | * | 4/2002 | Geringer et al. | 70/432 |
| 6,568,230 | B1 | * | 5/2003 | Chen | 70/419 |
| 6,622,537 | B2 | * | 9/2003 | Rodriguez | 70/432 |
| 7,878,035 | B2 | * | 2/2011 | Yamaguchi et al. | 70/161 |
| 2002/0124610 | A1 | * | 9/2002 | Harwood | 70/278.3 |
| 2006/0254330 | A1 | | 11/2006 | Geringer et al. | |
| 2009/0090148 | A1 | * | 4/2009 | Kollin et al. | 70/263 |

OTHER PUBLICATIONS

Corbin Russwin Architectural Hardware, PCT International Search Report, dated Apr. 29, 2010.

Corbin Russwin Architectural Hardware, PCT International Written Opinion, dated Apr. 29, 2010.

Corbin Russwin Architectural Hardware, Canadian Application No. 2,751,272, Office Action dated Jul. 28, 2014.

Corbin Russwin Architectural Hardware, European Application No. 10702979.5, Office Action, Apr. 29, 2013.

* cited by examiner

SELF-ADJUSTING CYLINDER MONITOR ASSEMBLY

CROSS-REFERENCES

This application is related to U.S. provisional application No. 61/148,519, filed Jan. 30, 2009, entitled "Self-Adjusting Cylinder Monitor Assembly", naming Tracy F. Fowler, Brian R. Fournier and Damon John Lenk as inventors. The contents of the provisional application are incorporated herein by reference in their entirety, and the benefit of the filing date of the provisional application is hereby claimed for all purposes that are legally served by such claim for the benefit of the filing date.

BACKGROUND

This invention relates generally to lock monitoring systems, and more particularly to a lock monitoring system for determining the position of a lock cylinder in a mortise lock assembly.

There are a number of different ways that users have attempted to make locks "tamper proof" using lock monitoring systems. Some systems incorporate alarms associated with the insertion of an incorrect key into a lock cylinder. The alarms cooperate with the inner workings of the lock cylinder, such as the pin/tumbler assembly, to signal when there is tampering with the pin/tumbler assembly within the cylinder. The alarms provide an audio or visual indication, or trigger a locking mechanism, when the pins within the lock cylinder are improperly manipulated.

Other conventional lock monitoring systems signal an alarm when the lock assembly is being pried or jimmied or otherwise forcibly engaged. The lock assembly includes sensors and, when there is an attempt to pry or damage the lock assembly or surrounding frame, the sensors signal an alarm.

Lock monitoring systems do not typically address the position of the lock cylinder. In a mortise lock assembly, the lock cylinder rotates a cam to place the lock in a locked condition or an unlocked condition, as well as to retract a latch or a deadbolt to a retracted position. Therefore, the rotation of the lock cylinder and cam is usually an indication of either ingress or egress through the door.

Mortise lock assemblies vary in size and depth. Similarly, lock cylinders also vary in size and depth, as does the shape and design of the cam. Thus, it is difficult to provide a lock monitoring system for a lock cylinder that will work effectively with all mortise lock assemblies and lock cylinders.

For the foregoing reasons, there is a need for a lock monitoring system that monitors the position of the lock cylinder. The new lock monitoring system should signal an alarm, or be integrated into an alarm system where rotation of the lock cylinder may be monitored for security reasons. Ideally, the new lock monitoring system should be applicable to new and existing mortise lock assemblies, especially in a retrofit application.

SUMMARY

The present invention provides for a lock cylinder monitor for monitoring the position of a lock cylinder. The lock cylinder monitor has a housing having an inner cavity and an exterior diameter, the exterior diameter being no greater than the corresponding lock cylinder diameter. The lock cylinder monitor also includes a switch received into the inner cavity of the housing. The switch is in electrical communication with an indicator. The lock cylinder monitor also includes a spring for urging the switch outwardly of the inner cavity of the housing, and a retainer for holding the spring adjacent to the switch.

The present invention further provides for a lock cylinder assembly having a lock cylinder, and a lock cylinder monitor for monitoring the position of the lock cylinder. The lock cylinder monitor includes a housing having an inner cavity and an exterior diameter, the exterior diameter being no greater than the corresponding lock cylinder diameter, a switch received into the inner cavity of the housing, the switch in electrical communication with an indicator, a spring for urging the switch into the inner cavity of the housing, and a retainer for urging the spring to remain adjacent to the switch.

Another aspect of the present invention provides for a mortise lock assembly having a mortise lock body, a lock cylinder, and a lock cylinder monitor assembly for monitoring the position of the lock cylinder. The lock cylinder monitor assembly has a housing having an inner cavity and an exterior diameter, the exterior diameter being no greater than the corresponding lock cylinder diameter. The lock cylinder monitor assembly further includes a switch received into the inner cavity of the housing, the switch in electrical communication with an indicator. The lock cylinder monitor assembly also includes a spring for urging the switch into the inner cavity of the housing, and a retainer for urging the spring to remain adjacent to the switch.

DESCRIPTION

The embodiments of a lock cylinder monitoring assembly described herein is for use in a mortise lock and may be used with any conventional mortise lock such as, for example, the mortise locks described by U.S. Pat. No. 6,393,878 and U.S. Pat. No. 6,349,982, the contents of which are hereby incorporated by reference. Accordingly, detailed explanations of the functioning of all of the components of the mortise lock are deemed unnecessary for understanding of the present invention by one of ordinary skill in the art.

Certain terminology is used herein for convenience only and is not to be taken as a limitation on the invention. For example, words such as "interior", "exterior", "upper," "lower," "left," "right," "horizontal," "vertical," "upward," and "downward" merely describe the configuration shown in the FIGs. Indeed, the components may be oriented in any direction and the terminology, therefore, should be understood as encompassing such variations unless specified otherwise.

Figure 1A:
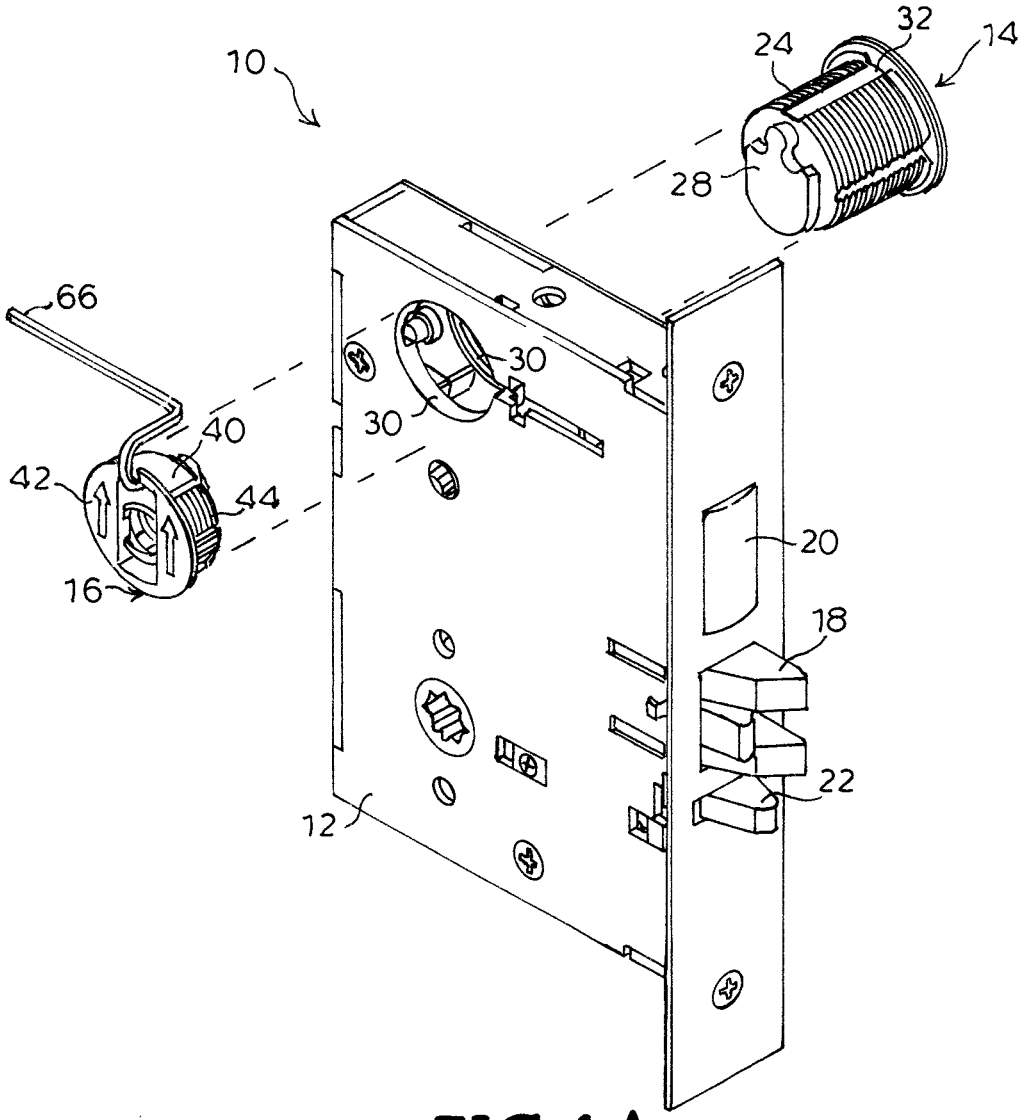
FIG. 1A is an exploded perspective view of a mortise lock assembly.

Referring now to the drawings, wherein like reference numerals designate corresponding or similar elements throughout the several views, FIG. 1A shows an embodiment of a mortise lock assembly generally designated at 10. The mortise lock assembly 10 is conventional and only a few of the mortise lock components are shown, including a lock case 12 and a key-operated lock cylinder 14. Also shown in FIG. 1A is an embodiment of a lock cylinder monitoring assembly, generally designated at 16.

As is known in the art, the mortise lock case 12 is adapted to fit into a mortised recess formed in the edge of a door (not shown) which is opposite to the edge of the door that is hinged to a door frame. The lock case 12 is generally rectangular and encloses the lock components. The principal lock components are a beveled latch bolt 18, a deadbolt 20 and an auxiliary bolt 22. Both of the latch bolt 18 and the deadbolt 20 may project from the case 12 beyond the edge of the door and into openings in the door frame to latch or lock the door in a closed position. The latch bolt 18 and the deadbolt 20 are moveable to a retracted position inside the case 12 to permit opening of the door by operation of a latch operator (not shown), such as a door knob or lever handle.

The lock cylinder 14 has an elongated threaded body 24. The cylinder body 24 accommodates a rotatable key plug 26, the inner end of which carries an eccentric cam 28. Rotation of the key plug 26 by a key in the cylinder body 24 causes corresponding rotation of the cam 28. The major side walls of the lock case 12 define opposed circular openings 30 in the upper rear corners for threadably receiving the lock cylinder 14. During installation of the mortise lock 10, a transverse opening is drilled in a face of the door and opens into the recess in the edge of the door. The transverse opening is positioned to align with the openings in the lock case 12 when the lock case 12 is in the recess. The lock cylinder 14 is inserted into the transverse opening and threaded into the opening 30 on one side of the lock case 12. The lock cylinder 14 is advanced into the lock case 12 until an outer trim flange 32 is flush against the door surface. The distance the cylinder body 24 advances into the lock case 12 will vary based on the thickness of the door.

As is known in the art, the cam 28 is adapted to operatively engage lock components to effect a locked condition and an unlocked condition of the mortise lock 10. Optionally, the cam 28 may function to selectively extend and retract the deadbolt 20 or retract the latch bolt 18. All of the operations of the cam 28 require rotation of a key in the lock cylinder 14 for rotating the key plug 26 and the cam 28.

Figure 1B:
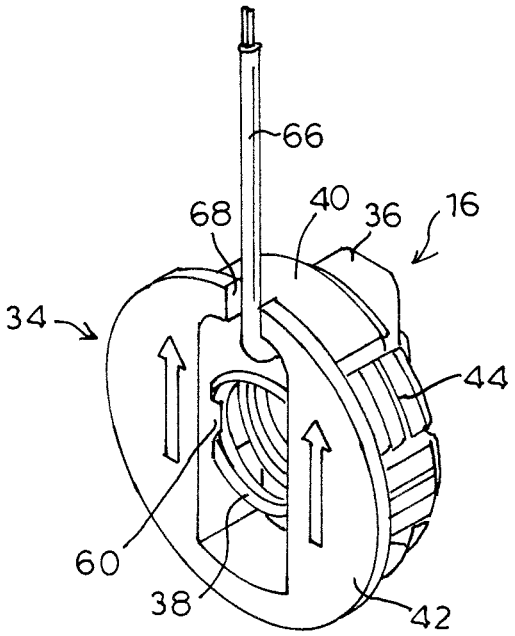
FIG. 1B is a perspective view of an embodiment of a lock cylinder monitoring assembly as shown in FIG. 1A.
Figure 2A:
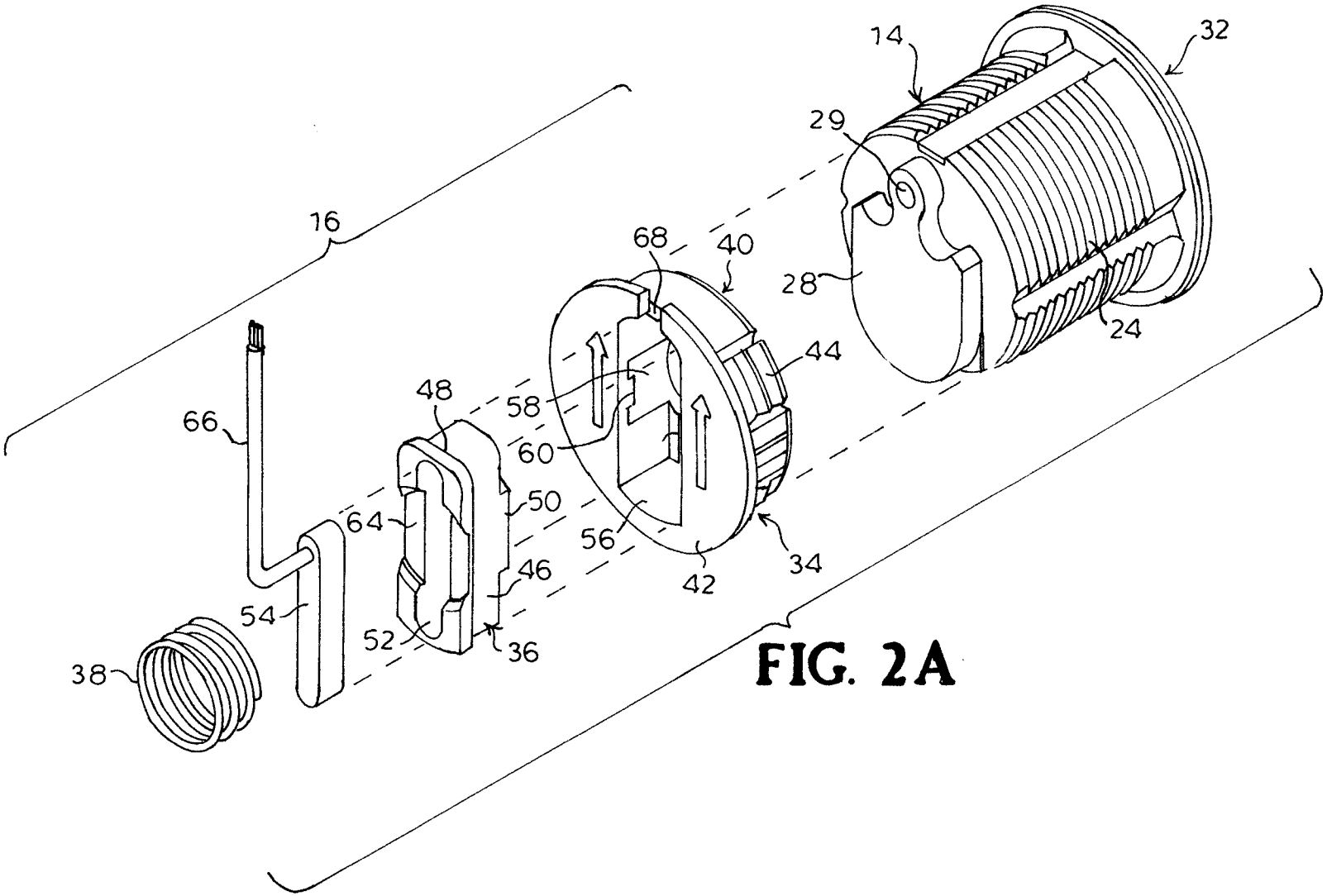
FIGS. 2A and 2B are exploded perspective views from opposite sides of the lock cylinder monitoring assembly and the lock cylinder as shown in FIG. 1A.
Figure 2B:
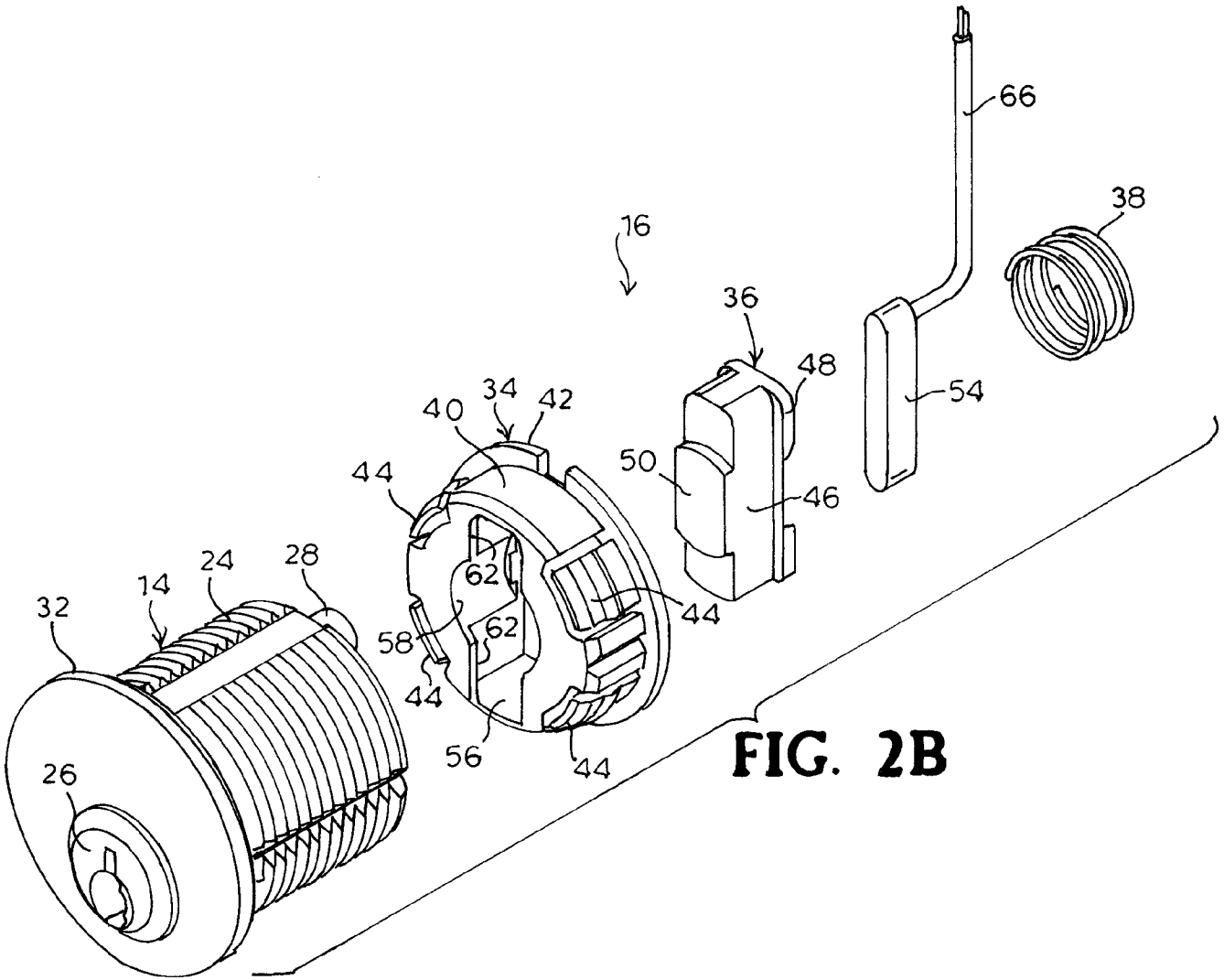
Figure 3:
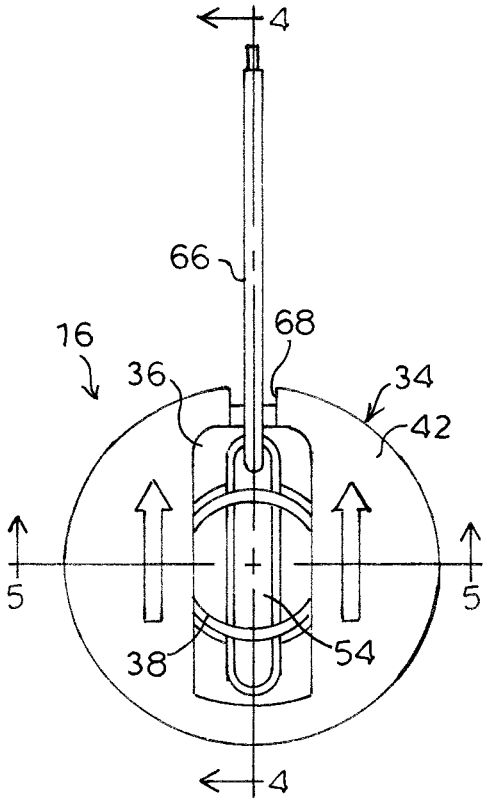
FIG. 3 is a front elevation view of the lock cylinder monitoring assembly as shown in FIG. 1B.

Referring to FIGS. 1B, 2A and 2B, the lock cylinder monitoring assembly 16 comprises a housing 34, a plunger 36 and a coil spring 38. The monitor housing 34 is a generally circular member, including an inner portion 40 of some depth and a generally planar outer flange portion 42. The outer flange portion 42 has a larger diameter than the inner portion 40 of the housing. The periphery of the inner portion 40 of the housing includes four flexible tabs 44 depending inwardly from the flange portion 42.

The plunger 36 is a generally rectangular member, including an inner portion 46 of some depth and a generally planar outer flange portion 48 of slightly larger dimensions than the inner portion 46 of the plunger 36. The inner portion 46 of the plunger 36 has an axial boss 50 extending partially along the inner surface. The plunger 36 defines an oblong recess 52 for receiving a switch 54. The switch 54 is fixed within the recess 52 using any number of suitable adhering means such as the application of an adhesive such as glue. Other methods of fixing the switch 54 within the plunger recess 52 are contemplated. They include but are not limited to mechanical means such as screws and pins, as well as other chemical means such as epoxy resin, as well as heat so as to melt the switch 54 within the recess 52. In an assembled position, the switch 54 is completely embedded within the switch recess 52 in the plunger 36.

The monitor housing 34 defines a pass through opening 56 which is sized and shaped to slidably receive the plunger 36. A pair of opposed arcuate walls 58 further define the opening 56 at the midpoint and partially form a spring recess. A pair of opposed axial tabs 60 extend inwardly from the outer flange portion 48 of the plunger 36 and into the arcuate portions 58 of the opening 56. The inner end of the opening 56 is defined by end walls 62 that integral with the inner portion 46 of the plunger 36 and extend transversely for partially closing the opening 56.

Figure 4:
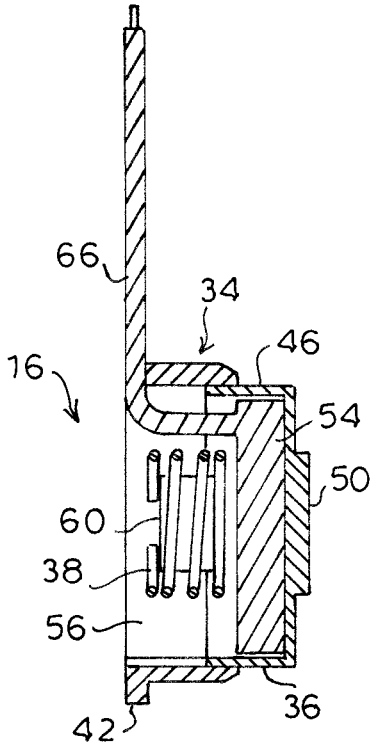
FIG. 4 is a cross-section view of the lock cylinder monitoring assembly taken along line 4-4 of FIG. 3.
Figure 5:
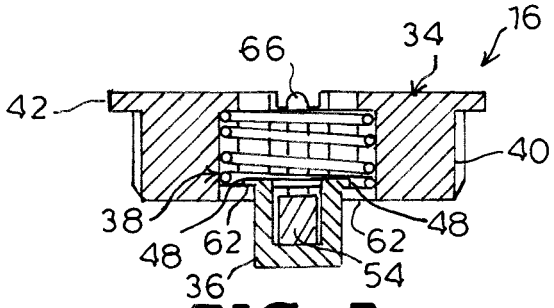
FIG. 5 is cross-section view of the lock cylinder monitoring assembly taken along line 5-5 of FIG. 3.

To assemble the lock cylinder monitoring assembly 16, the plunger 36 and switch 54 are slipped into the opening 56 in the housing 34. The plunger 36 slides freely within the housing 34. Inward axial movement of the plunger 36 is limited by engagement of the outer flange portion 48 of the plunger 36 with the end walls 62 at the inner end of the opening 56. The spring 38 is then placed within the opening 56 in the spring recess partially defined by the arcuate inner walls 58 of the housing 34. The outer surface of the plunger 36 defines a partial circular recess 64 for receiving the inner end of the spring 38. The spring 38 is held in compression by positioning the outer coil under the tabs 60. The spring 38 thus serves to hold the plunger 36 within the housing 34 while biasing the plunger 36 against the end walls 62, as best seen in FIGS. 4 and 5. It is understood that other means for inwardly biasing the plunger 36 are possible. Thus, we do not intend to limit ourselves to the specific embodiments of the spring biasing means shown herein.

Figure 6A:
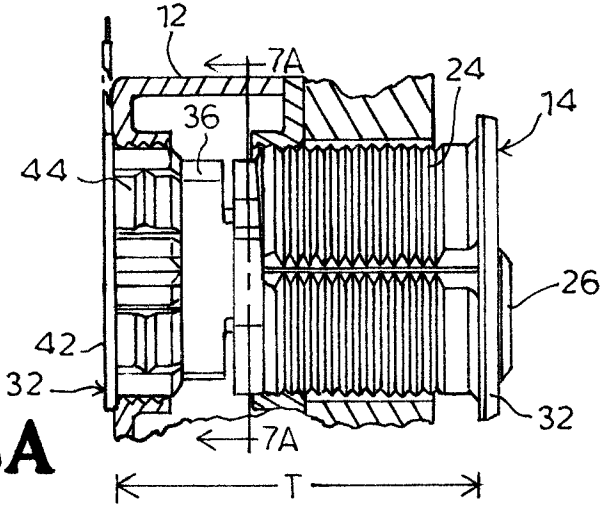
FIG. 6A is a side elevation view of the lock cylinder monitoring assembly and the lock cylinder as shown in FIG. 1A in a first position relative to a mortise lock housing shown in cross-section.
Figure 6B:
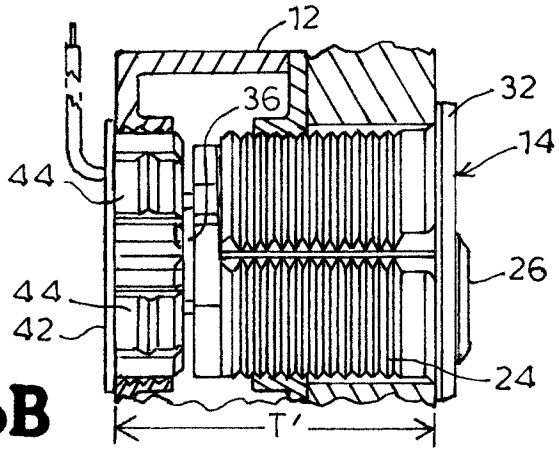
FIG. 6B is a side elevation view of the lock cylinder monitoring assembly and the lock cylinder as shown in FIG. 6A in a second position relative to a mortise lock housing shown in cross-section.
Figure 8A:
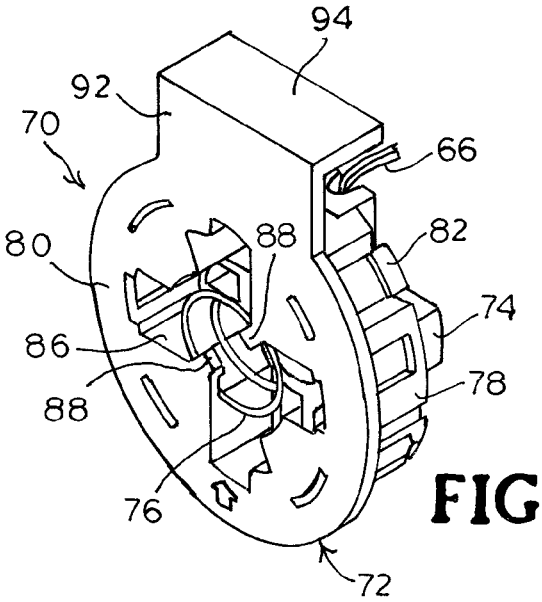
FIGS. 8A and 8B are a perspective view and an exploded perspective view, respectively, of another embodiment of a lock cylinder monitoring assembly.
Figure 8B:
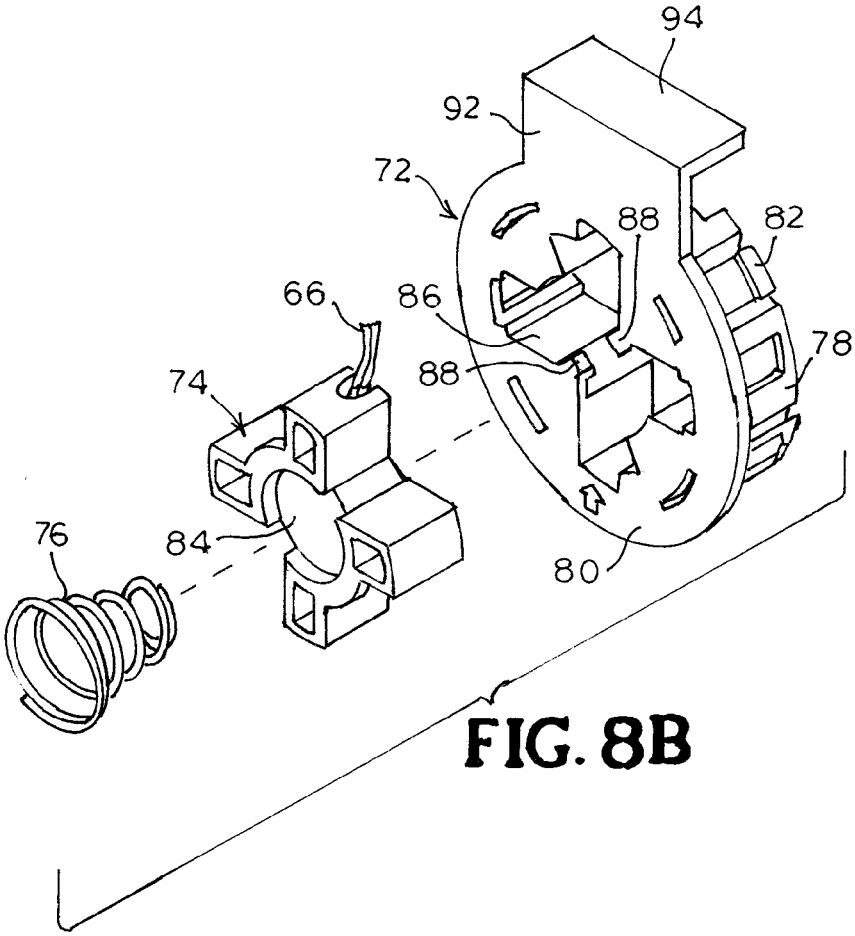
Figure 9A:
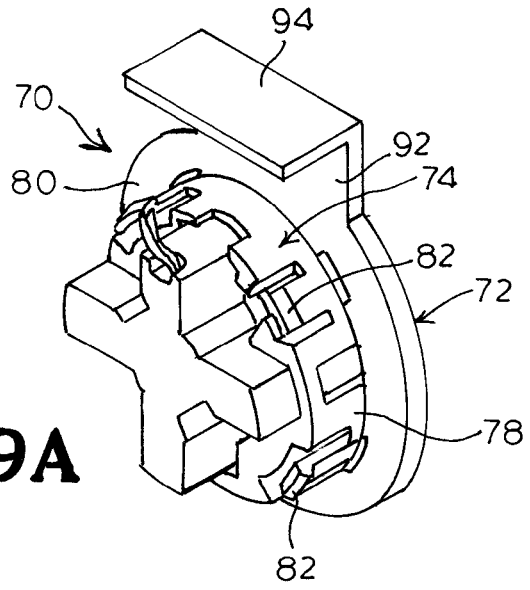
FIGS. 9A and 9B are a perspective view and an exploded perspective view, respectively, of the lock cylinder monitoring assembly shown in FIGS. 8A and 8B from the opposite side as shown in FIGS. 8A and 8B.
Figure 9B:
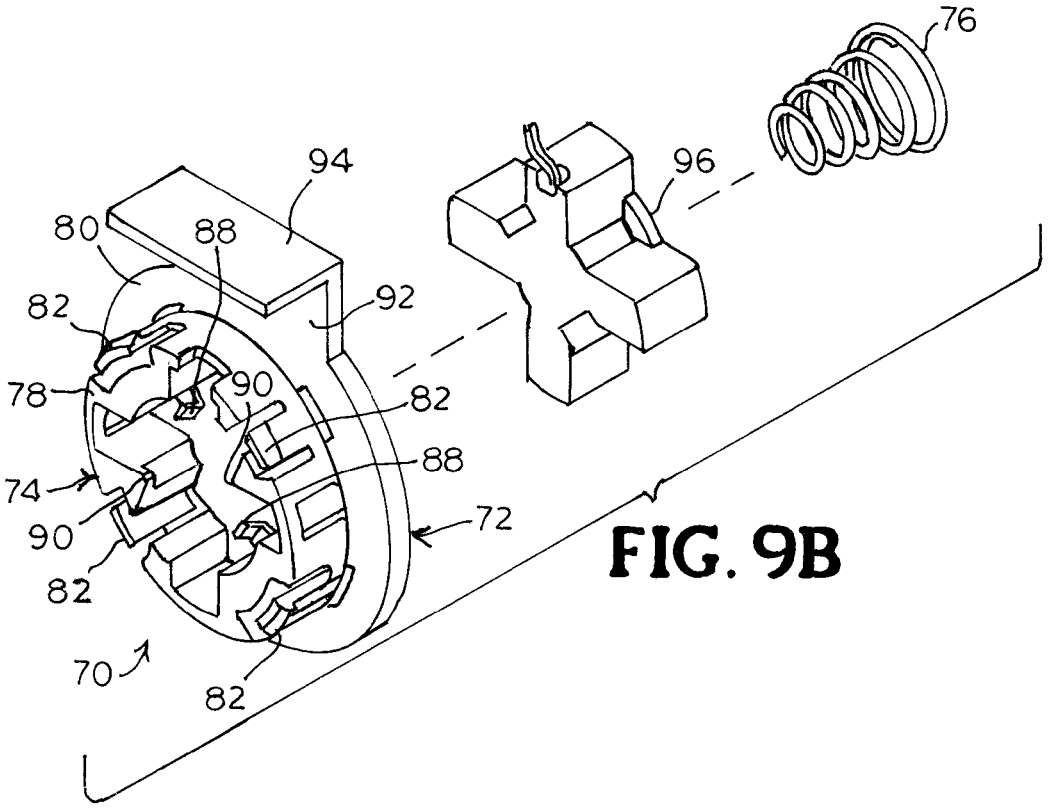
Figure 10:
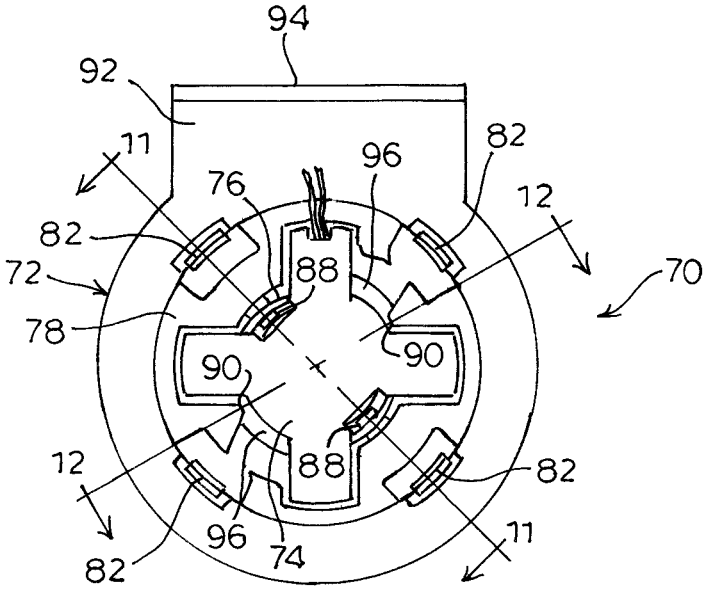
FIG. 10 is a front elevation view of the lock cylinder monitoring assembly as shown in FIGS. 8A-9B.

The inner portion 40 of the monitor housing 34 is sized to be received in the cylinder opening 30 in the case 12 opposite the lock cylinder 14. Referring to FIGS. 6A and 6B, the inner portion 40 of the housing 34 is press fit into the opening 30 in the case 12. As the housing 34 advances into the case 12, the flexible tabs 44 on the flange portion of the housing 34 engage the case 12 adjacent the opening 30 and flex inwardly. As the housing 34 advances into the case 12, the tabs 44 clear the wall of the case 12 and snap outwardly. Ridges on the tabs 44 thus engage the inner surface of the wall of the case 12 for holding the lock cylinder monitoring assembly 16 in the lock case 12.

As described above, during installation of the mortise lock 10, the lock cylinder 14 is inserted through an opening in the door face and threaded into the opening 30 in the lock case 12. As the lock cylinder 14 is threaded into the case 12, the boss 50 on the plunger 36 initially engages the cam 28 of the lock cylinder 14. As the lock cylinder 14 advances, the plunger 36 is pushed into the housing 34 against the force of the spring 38 until the trim flange 32 on the lock cylinder 14 is flush against the door surface. Thus, the lock cylinder monitoring assembly 16 is able to accommodate varying depths of lock cylinder 14 intrusion into the case 12 due to lock cylinder bodies 24 of varying lengths and varying door thicknesses.

In an assembled position, the lock cylinder 14 and the lock cylinder monitoring assembly 16 make frictional contact at the cam 28 and the boss 50. A magnet 29 is embedded flush with the surface of the cam 28 so that the cam 28 is free to rotate within the lock case 12. In one embodiment, the switch 54 is a Reed switch, which operates by an applied magnetic field. The switch 54 has at least one pair of electrical contacts (not shown) therein. The contacts remain either normally open or normally closed when a magnetic field is applied. In one embodiment, the contacts within the switch 54 are normally closed when a magnetic field is applied. Thus, if the magnet 25 were to move upon rotation of the cam 24, the switch 54 would open at the absence of a magnetic field for generating an electric signal indicating that the cam 28 has moved. As seen in the FIGs., electrical wiring 66 is provided for electrically connecting the switch 54. A radial notch 68 in the flange portion 42 of the housing 34 is sized and dimensioned to pass the wire 66.

Figure 7A:
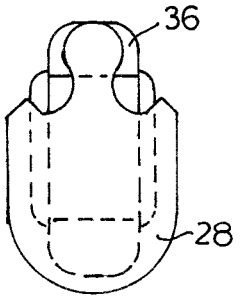
FIG. 7A is an elevation view of a cam of a lock cylinder and a portion of a lock cylinder monitoring assembly in a first relative position.
Figure 7B:
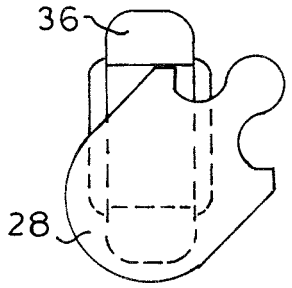
FIG. 7B is an elevation view of the cam and the portion of the lock cylinder monitoring assembly as shown in FIG. 7A in a second relative position.

FIG. 7A shows the cam 28 in an initial home position where switch 54 is aligned with the magnet 29 embedded in the cam 28. When a key is inserted in the key plug 26, the key, key plug 26 and cam 28 can rotate together for effecting a lock function. FIG. 7B shows the position of the cam 28 after rotation from the home position. When the cam 28 rotates, the magnet 29 moves away from the switch 54. Because the switch 54 is able to indicate presence or loss of magnetic field, if the switch 54 is normally closed the switch 54 opens and thus disrupts the normal flow of current in the circuit. This sends an electrical signal over the wire 66 generally indicating that the cam 28 has moved from its home position.

The wire 66 from the switch 54 may be connected to a remote alarm or other indicator (not shown). The indicator may be an audio or visual signal, or may be connected to an alarm/security system where the signal from the indicator may be recorded as an event for security auditing, shunt an alarm when lock cylinder use is acceptable (i.e., lock cylinder used to open door instead of electronic credential (keycard, pin code)), or notify security or initiate an alarm at a time when lock cylinder use is not acceptable. Uses of the signal from the switch 54 may be expanded to accommodate specific security requirements as well as alarm system monitoring capabilities.

Referring now to FIGS. 8A-9B, another embodiment of a cylinder lock monitoring assembly is shown and generally designated at 70. The lock cylinder monitoring assembly 70 comprises a housing 72, a plunger 74 and a coil spring 76. As in the previous embodiment, the monitor housing 72 is a generally circular member, including an inner portion 78 and an outer flange portion 80 of a larger diameter and including four inwardly depending flexible tabs 82. In this embodiment, the outer flange portion 80 further comprises a planar extension 92 which projects upwardly and terminates in a perpendicular flange 94 that extends inwardly from the extension 92.

The plunger 74 is a generally X-shaped member. The plunger 74 defines a central circular blind bore 84 for receiving the spring 76. A switch sensitive to a magnetic field is integral with the plunger 74. The monitor housing 72 defines an X-shaped pass through opening 86 which is sized and shaped to slidably receive the plunger 74. A pair of opposed axial tabs 88 extend inwardly from the outer flange portion 80 into the opening 86. The housing 72 also has a pair of opposed axial tabs 90 at the inner end of the opening 86 that extend transversely from the inner portion 78 into the opening 86.

Figure 11:
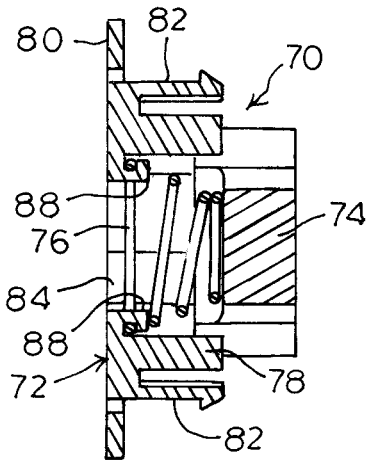
FIG. 11 is a cross-section view of the lock cylinder monitoring assembly taken along line 11-11 of FIG. 10.
Figure 12:
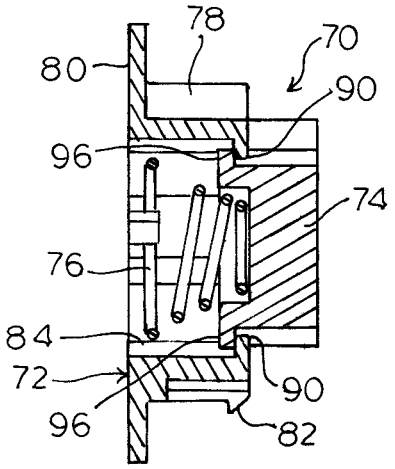
FIG. 12 is cross-section view of the lock cylinder monitoring assembly taken along line 12-12 of FIG. 10.

To assemble the lock cylinder monitoring assembly 70, the plunger 74 is slipped into the opening 86 in the housing 72 and slides freely within the housing 72. Inward axial movement of the plunger 74 is limited by engagement of the tabs 90 on walls 96 connecting the legs of the plunger 74. The spring 76 is then placed within the opening 84 and positioning the outer coil under the axial tabs 88. As in the previous embodiment, the spring 76 thus serves to hold the plunger 74 within the housing 72 while biasing the plunger 74 inwardly against the tabs 90, as best seen in FIGS. 11 and 12.

Figure 13A:
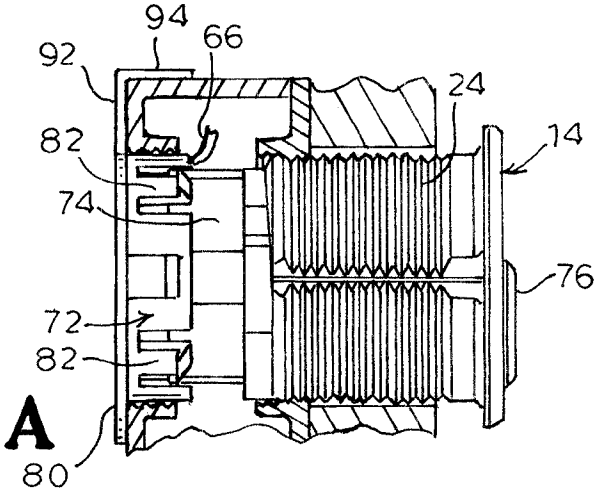
FIG. 13A is a side elevation view of the lock cylinder monitoring assembly as shown in FIGS. 8A-9B and a lock cylinder in a first position relative to a mortise lock housing.
Figure 13B:
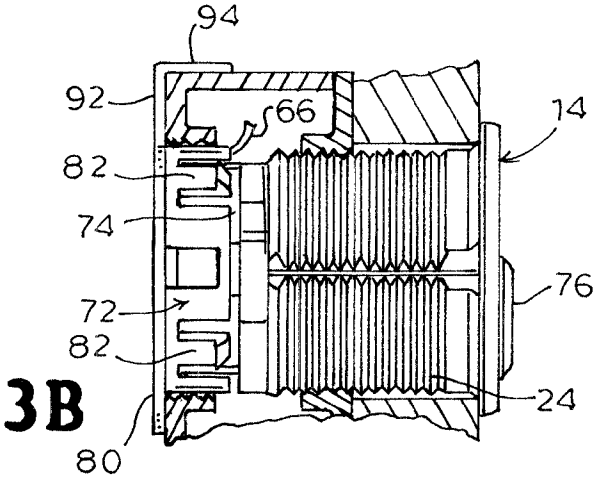
FIG. 13B is a side elevation view of the lock cylinder monitoring assembly and the lock cylinder as shown in FIG. 13A in a second position relative to a mortise lock housing.

The inner portion 78 of the monitor housing 72 is received in the cylinder opening 30 in the lock case 12 in the same manner as the previous embodiment. Referring to FIGS. 13A and 13B, in this embodiment the extension 92 lies against the wall of the case and the flange 94 fits into a slot 98 in the top wall of the case 12. In use, this embodiment of the lock cylinder monitoring assembly 70 functions the same way as the previous embodiment. As the lock cylinder 14 is threaded into the opening 30 in the lock case 12, the plunger 74 initially engages the cam 28 and is pushed into the housing 72 against the force of the spring 76 until the trim flange 32 on the lock cylinder 14 is flush against the door surface. In use, the switch integral with the plunger 74 senses the magnet 29 in the cam 28. Accordingly, the switch generates an electric signal indicating that the cam 28 has moved, which signal is communicated via the electrical wiring 66.

It is understood that the embodiments of the lock cylinder monitoring assembly described herein may be retrofit to existing single cylinder mortise lock designs. The mortise lock assembly would be installed as a standard mortise lock assembly, except that the wiring from the switch to the indicator would need to be provided.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. Accordingly, we intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. A cylinder lock monitor for monitoring a position of a cylinder lock including a rotatable element having an axis of rotation, the cylinder lock monitor comprising:

a cylinder lock monitor housing adapted to be positioned proximate to the rotating element of the cylinder lock, the cylinder lock monitor housing having an inner end and defining an inner cavity opening through the inner end of the housing;

a plunger having an inner end and disposed in the cavity of the housing, the plunger configured for non-rotating axial movement relative to the housing along the axis of rotation of the rotatable element between a first position where the inner end of the plunger extends from the opening in the inner end of the housing and a second position where the inner end of the plunger is contiguous with the inner end of the housing;

a spring disposed in the cavity of the housing for biasing the plunger toward the first position; and a switch operatively associated with the housing, the switch in electrical communication with an indicator and adapted to be reactive to any change in position of the rotatable element of the cylinder lock, wherein the inner end of the plunger is adapted to contact the rotatable element between and including the first and second positions of the plunger during rotation of the rotatable element relative to the plunger.

2. The cylinder lock monitor of claim 1 wherein the switch is integral with the plunger.

3. The cylinder lock monitor of claim 1 wherein the switch is wired to the indicator at a remote location.

4. The cylinder lock monitor of claim 3 wherein the indicator is in electrical communication with an alarm system.

5. A cylinder lock assembly comprising:

a cylinder lock including a rotatable element having an axis of rotation, the rotatable element configured for effecting position of the lock components; and a cylinder lock monitor positioned proximate to the cylinder lock for monitoring the position of the rotatable element, the cylinder lock monitor comprising:

a housing having an inner end and defining an inner cavity opening through the inner end of the housing, a plunger having an inner end and disposed in the cavity of the housing, the plunger configured for non-rotating axial movement relative to the housing along the axis of rotation of the rotatable element between a first position where the inner end of the plunger extends from the opening in the inner end of the housing and a second position where the inner end of the plunger is contiguous with the inner end of the housing;

a spring disposed in the cavity of the housing for biasing the plunger toward the first position; and a switch mounted on the plunger, the switch in electrical communication with an indicator and reactive to any change in position of the rotatable element of the cylinder lock, wherein the inner end of the plunger is adapted to contact the rotatable element between and including the first and second positions of the plunger during rotation of the rotatable element relative to the plunger.

6. The cylinder lock assembly of claim 5 wherein the rotating element comprises a cam and the housing is adjacent to the cam.

7. The cylinder lock assembly of claim 6 wherein the switch comprises a Reed switch, and further comprising a magnet mounted on the cam.

8. The cylinder lock assembly of claim 5 wherein the switch is wired to the indicator at a remote location.

9. The cylinder lock assembly of claim 8 wherein the indicator is in electrical communication with an alarm system.

10. A mortise lock assembly comprising:

a mortise lock body including two principal side walls and edge walls extending between and interconnecting the side walls, the side walls of the body each having at least one opposed opening;

a cylinder lock including a rotatable element having an axis of rotation, the rotatable element configured for effecting position of the lock components, the cylinder lock configured to be received in the opening in one of the side walls so that the rotatable element is inside the mortise lock body; and a cylinder lock monitor assembly for monitoring the position of the rotatable element, the cylinder lock monitor assembly comprising:

a housing having an inner end and defining an inner cavity opening through the inner end of the housing, a plunger having an inner end and disposed in the cavity of the housing, the plunger configured for non-rotating axial movement relative to the housing along the axis of rotation of the rotatable element between a first position where the inner end of the plunger extends from the opening in the inner end of the housing and a second position where the inner end of the plunger is contiguous with the inner end of the housing;

a spring disposed in the cavity of the housing for biasing the plunger toward the first position; and a switch mounted on the plunger, the switch in electrical communication with an indicator and reactive to any change in position of the rotatable element of the cylinder lock, wherein the cylinder lock monitor housing is configured to be received in the opening in the other of the sidewalls so that the inner end of the plunger is inside the mortise lock body and contacts the rotatable element between and including the first and second positions of the plunger during rotation of the rotatable element relative to the plunger.

11. The mortise lock assembly of claim 10 wherein the rotating element is a cam and the cylinder lock monitor housing is mounted adjacent to the cam.

12. The mortise lock assembly of claim 10 wherein the switch is a Reed switch, and further comprising a magnet mounted on the cam.

13. The mortise lock assembly of claim 10 wherein the switch is wired to the indicator at a remote location.

14. The mortise lock assembly of claim 13 wherein the indicator is in electrical communication with an alarm system.

* * * * *